US006752305B2

(12) United States Patent
Shattuck

(10) Patent No.: US 6,752,305 B2
(45) Date of Patent: Jun. 22, 2004

(54) IDENTIFICATION HOLDER SYSTEM

(75) Inventor: John Shattuck, 115 Beech Ct., Erie, CO (US) 80516

(73) Assignee: John Shattuck, Erie, CO (US)

( * ) Notice: Subject to any disclaimer, the term of this patent is extended or adjusted under 35 U.S.C. 154(b) by 80 days.

(21) Appl. No.: 10/123,538

(22) Filed: Apr. 15, 2002

(65) Prior Publication Data

US 2003/0178461 A1 Sep. 25, 2003

Related U.S. Application Data

(63) Continuation-in-part of application No. 10/104,981, filed on Mar. 22, 2002.

(51) Int. Cl.[7] ..... G09F 3/18

(52) U.S. Cl. ..... 224/603; 224/614; 224/222; 224/269; 40/1.6; 150/145; 24/3.2; 24/3.4

(58) Field of Search ..... 224/600, 603, 224/219, 222, 660, 269, 681–684, 614, 604; 24/3.2, 3.4, 3.12, 3.13; 40/586, 1.5, 1.6, 661, 661.08, 665, 667, 654.01, 124.06, 27, 640; 150/132, 138, 140, 143, 145, 147, 149

(56) References Cited

U.S. PATENT DOCUMENTS

| | | | | | |
|---|---|---|---|---|---|
| 2,796,904 | A | * | 6/1957 | Joseph | 150/140 |
| 3,214,852 | A | * | 11/1965 | Ford et al. | 40/640 |
| 3,446,260 | A | * | 5/1969 | Osher | 150/147 |
| 3,829,995 | A | * | 8/1974 | Fakoury | 40/649 |
| 4,332,338 | A | * | 6/1982 | Christiansen | 224/222 |
| 4,890,728 | A | * | 1/1990 | Grimsley | 150/147 |
| 4,942,913 | A | * | 7/1990 | Musso | 150/138 |
| 4,958,855 | A | * | 9/1990 | Shipp | 150/147 |
| 5,027,477 | A | | 7/1991 | Seron | |
| 5,178,311 | A | * | 1/1993 | McBride | 224/191 |
| 5,215,237 | A | * | 6/1993 | Wu | 224/230 |
| 5,244,135 | A | * | 9/1993 | Nelson | 224/604 |
| 5,379,928 | A | | 1/1995 | Mikkelsen | |
| 5,388,739 | A | * | 2/1995 | Gargan | 224/604 |
| 5,533,238 | A | | 7/1996 | Say | |
| 5,564,166 | A | * | 10/1996 | Roy | 24/3.11 |
| 5,640,742 | A | * | 6/1997 | White et al. | 24/3.12 |
| D382,503 | S | * | 8/1997 | Kalbach | D11/7 |
| 6,073,317 | A | | 6/2000 | Barison | |
| 6,085,449 | A | * | 7/2000 | Tsui | 40/1.6 |
| 6,108,957 | A | * | 8/2000 | Zapawa | 40/654.01 |
| D435,340 | S | * | 12/2000 | Kojoori | D3/250 |
| 6,601,622 | B1 | * | 8/2003 | Young | 150/138 |
| 6,681,972 | B1 | * | 1/2004 | Tapocik | 150/147 |
| 2001/0054245 | A1 | * | 12/2001 | Williams | 40/661 |
| 2003/0037416 | A1 | * | 2/2003 | Buettell | 24/122.6 |

* cited by examiner

*Primary Examiner*—Nathan J. Newhouse
(74) *Attorney, Agent, or Firm*—Greenlee, Winner and Sullivan, P.C.

(57) ABSTRACT

A non-rigid identification card holder system is provided which can be attached to a breakaway lanyard for holding the identification card about the neck, to a clip for attaching the identification card to an article of clothing, or to a band for securing the card about the arm or leg. The identification card holder comprises at least one pocket sized to hold the identification card. In a preferred embodiment, at least one face of the pocket comprises a transparent polymeric material to allow easy viewing of the card. Any information contained on electronic chips which may be part of the card can also be scanned through the transparent material. A reinforced hole may be provided in the pocket face through which a finger may be inserted to aid in removing the identification card from the pocket. In another preferred embodiment, the card holder has two back-to-back pockets with the outer face of each pocket comprising a window of transparent polymeric material. The identification card holder may also provide additional pockets sized to hold ATM cards, phone cards, credit cards, photographs, security cards etc. For improved durability, the identification card holder may be made of a second material such as a woven material or nylon in addition to the first transparent polymeric material.

12 Claims, 4 Drawing Sheets

IDENTIFICATION HOLDER SYSTEM

CROSS-REFERENCE TO RELATED APPLICATIONS

This application is a continuation-in-part of U.S. patent application Ser. No. 10/104,981, filed Mar. 22, 2002, which is hereby incorporated in its entirety by reference to the extent not inconsistent with the disclosure herein.

BACKGROUND OF THE INVENTION

Commercially available protective identification card holders or badge holders include both holders which are used primarily for display of the identification card and holders which are used primarily for storage of the identification card, such as wallet-style holders. A non-rigid display-type identification card or badge holder is typically made wholly of flexible plastic and has a single pocket which substantially encloses the card, but allows removal of the card at one edge of the pocket. The card holder often is provided with a slot and/or holes spaced away from the pocket for connection to a neck lanyard, clip, pin, or other attachment device. An attachment device such as a clip may also be attached directly to the holder. Such plastic holders are subject to tearing at the edges of the pocket and at the point(s) of connection to the display device. A single pocket holder also does not allow separated storage of either multiple identification cards or of an identification card with another card such as a credit card. Separated storage of multiple cards allows the cards to be more easily organized. In general, separated storage of multiple cards also allows proper operation of cards containing magnetic information.

Seron (U.S. Pat. No. 5,027,477) discloses a breakaway lanyard loop containing a breakaway element which defines a weak point in the loop. When sufficient force is applied to the loop, the loop will open at the breakaway element. Seron's FIG. 1 shows that the breakaway lanyard may be attached to an identification card by a mounting element such as a hook. Seron teaches that the mounting element should be at a fixed location on the loop. Depending on the placement of the breakaway element, having a fixed mounting element can limit adjustment of the loop size to fit a wearer. Seron does not appear to address protective covers or holders for identification cards. Different breakaway elements are disclosed in U.S. Pat. Nos. 5,379,928, 5,533,238, and 6,073,317.

The present invention provides an attractive, durable, non-rigid identification card holder which is capable of being connected to a breakaway lanyard, a clip, or a band. The identification card holder may optionally provide separated storage for more than one identification card or for one or more identification cards and other cards such as credit, ATM, or phone cards. Separated storage of multiple cards allows more convenient organization of the cards and in general allows proper operation of cards containing magnetic information. Such an identification card holder is especially useful for airline personnel such as pilots, who are typically required to carry at least one identification card as well as a flight plan, as well as mechanics and rampers.

SUMMARY OF THE INVENTION

The present invention is in the field of non-rigid identification card holders, especially holder systems which can be attached to a breakaway lanyard for holding the identification card about the neck, to a clip for attaching the identification card to an article of clothing, or to a band for securing the identification card to an arm or leg.

The present invention provides a system for holding at least one identification card. The system allows a non-rigid identification card holder to be attached to a breakaway lanyard for holding the identification card about the neck, to be attached to a clip for securing the identification card to an article of clothing, or to be attached to a band for securing the identification card to an arm or leg. In one embodiment, the lanyard, clip and/or band may be reversibly interchangeable. In general, breakaway lanyards are safer than non-breakaway lanyards since they prevent choking of the wearer. In a preferred embodiment, the breakaway lanyard makes noise when the lanyard loop is opened, thus alerting the wearer of possible loss or theft of the identification card holder.

The identification card holder comprises at least one pocket sized to hold the identification card. In a preferred embodiment, at least one face of the pocket comprises a transparent polymeric material to allow easy viewing of the card. If the card is a smart card containing electronically coded information, e.g. on an electronic chip, the card can also be scanned or read through the transparent material by a smart card reader. A reinforced hole, for example a thumb slide, may be provided in one pocket face through which a finger may be inserted to aid in removing the identification card from the pocket. In another preferred embodiment, the card holder has two back-to-back pockets with the outer face of each pocket comprising a window of transparent polymeric material. These two pockets provide separated storage for two identification cards. The identification card holder may also provide additional pockets sized to hold ATM cards, phone cards, credit cards, security cards, photographs, etc.

For improved durability, the identification card holder may be made of a second material such as a woven material or leather in addition to the first transparent polymeric material. It is preferred that the means for attachment of the breakaway lanyard or clip connects to a portion of the identification card holder made of this second, more durable material.

DETAILED DESCRIPTION OF THE INVENTION

The present invention provides a system for holding at least one identification card. As used herein, the term "identification card" encompasses cards, tags, or badges which carry identifying information. An identification card can have information encoded on it within a magnetic stripe or within an electronic chip, in which case it may also be called a smart card or proximity card. Information encoded on a smart card is typically scanned or read with a smart card reader.

Figure 1A:
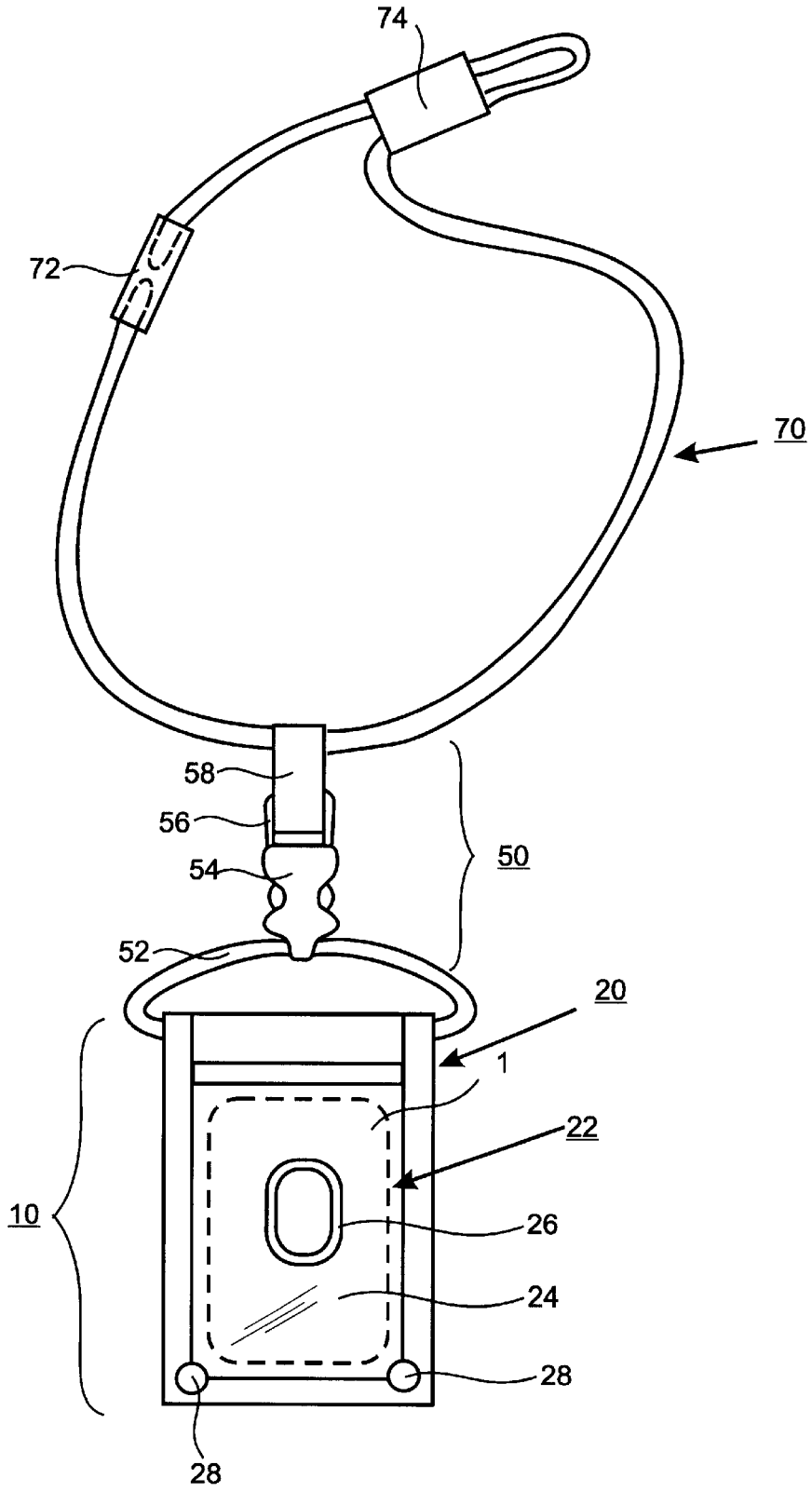
FIG. 1A illustrates one embodiment of identification card holder system of the invention. The card holder is attached to a breakaway lanyard.

The present invention provides an identification card holder system which can be attached to a breakaway lanyard for holding the identification card about the neck, to a clip, preferably an alligator clip, for attaching the identification card to an article of clothing, or to a band for securing the holder about an arm or leg. In one embodiment, the lanyard, clip and/or band may be reversibly interchangeable. By reversibly interchangeable it is meant that, for example, the identification card holder can be easily removed from the lanyard and replaced with the clip or vice versa. FIGS. 1A–1C and 2A–2B illustrate identification card holder systems of the invention. The identification card (1) is contained within an identification card holder (10). In FIG. 1A, attachment means (50) slidably attach holder (10) to breakaway lanyard (70). In FIG. 1C, clip attachment means (80) attach holder (10) to alligator clip (90). In FIGS. 2A and 2B, holder (10) is permanently attached to a band for securing the holder about an arm.

In general, the card holder comprises at least one pocket sized to hold an identification card. It is preferred that at least one face of the pocket comprises a transparent polymeric material to allow easy viewing of the card. Any information contained on electronic chips which may be part of the card can also be scanned through the transparent material. The pocket face may be formed wholly of transparent material or may have only a window of transparent material. The card holder shown in FIGS. 1A–1C and 2A–2B has front and back flaps which fold over each other and fasten together. The front flap of the card holder has two back-to-back pockets which share a common inner face.

The card holder preferably comprises a first material which is transparent polymer sheet and a second material which is a woven material or leather. For improved durability of the holder, it is preferred that the second material be more durable than the first. In a preferred embodiment, the second material is 500 denier nylon. The transparent polymeric material is preferably used only in making the pockets. The durability of a pocket can be improved by using a woven material or leather in at least one face of the pocket and/or as binding for the edge of the pocket.

FIG. 1A shows the front flap (20) of the card holder (10) with exterior pocket (22) containing identification card (1). The exterior pocket has two faces, an outer face (24) and an inner face ((35) in FIG. 1B). Preferably, the outer face (24) comprises a durable transparent polymeric material. In FIG. 1A, the outer face (24) is shown as containing a reinforced hole (26) through which a finger may be inserted to more easily remove the identification card from the exterior pocket. This reinforced hole may also be termed a thumb slide. The hole may be reinforced by deforming the material immediately surrounding the hole during manufacture of the pocket face (24). The inner face of exterior pocket (22) may be of any durable, flexible material which does not stretch such as a woven material or leather. The inner and outer faces of exterior pocket (22) may be joined by sewing or by other means as known to the art. The edges of the pocket faces may be covered for a more attractive appearance and/or to reinforce the pocket. For example, the edges of a pocket may be bound with fabric tape prior to sewing. In the embodiment shown in FIG. 1A, the exterior pocket (22) does not open to the exterior side of the front flap. Instead, the card in exterior pocket (22) is inserted or removed from the interior side of the front flap. The front flap fastens to the back flap. Any fastener known to the art such as snaps or hook-loop material may be used. In FIG. 1A–1C and FIG. 2A–2B, snaps (28) join the front flap (20) to the back flap ((40) in FIG. 1B and described below).

Figure 1B:
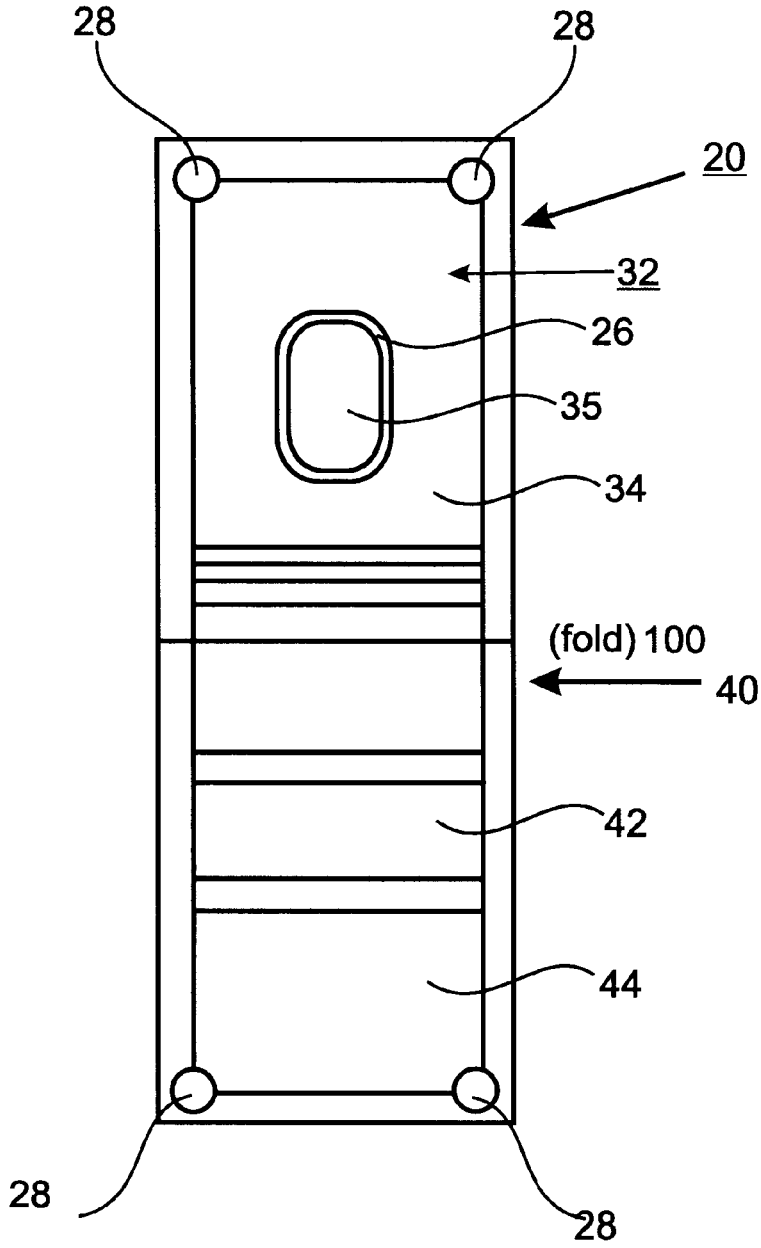
FIG. 1B illustrates the interior of the opened card holder of FIG. 1.
Figure 1C:
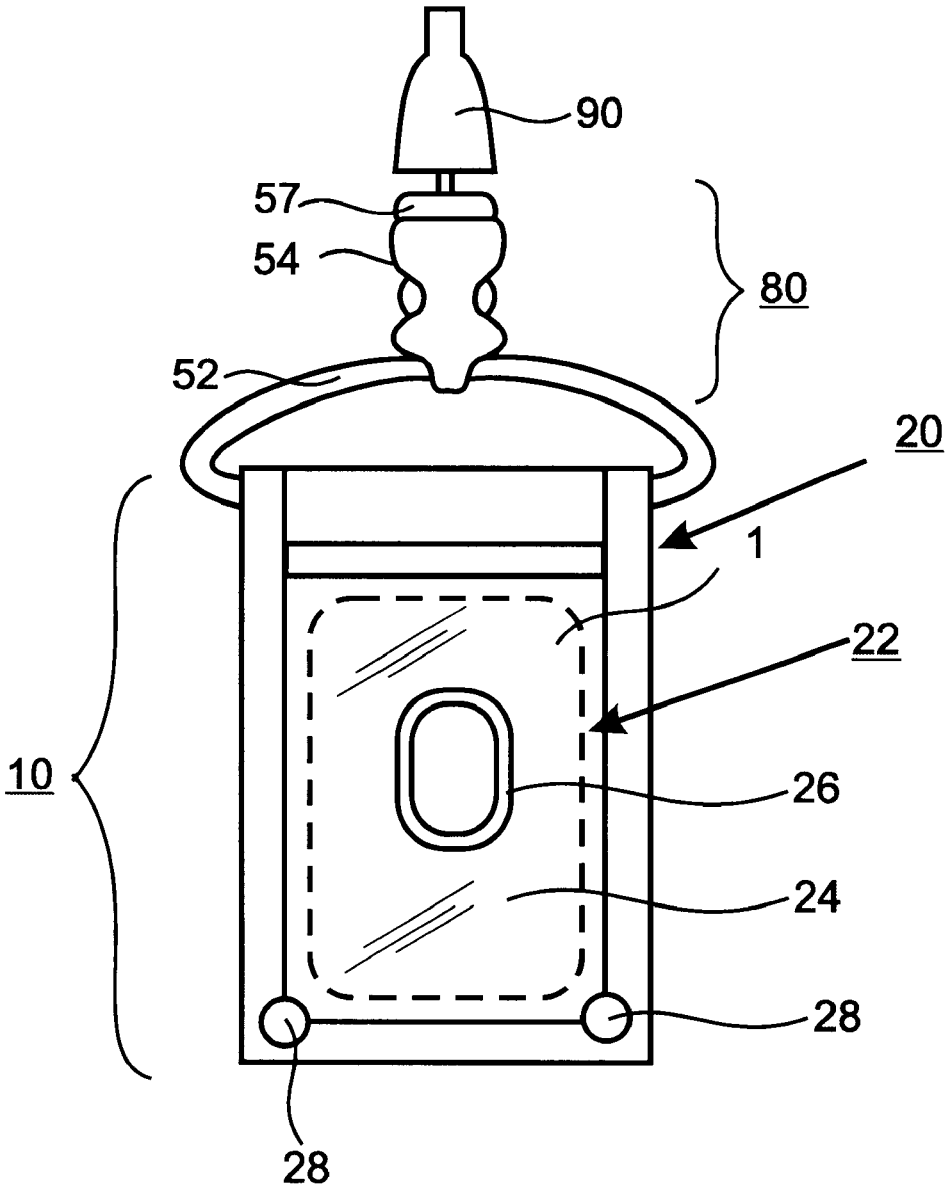
FIG. 1C illustrates the card holder of FIG. 1 attached to an alligator clip rather than a breakaway lanyard.
Figure 2A:
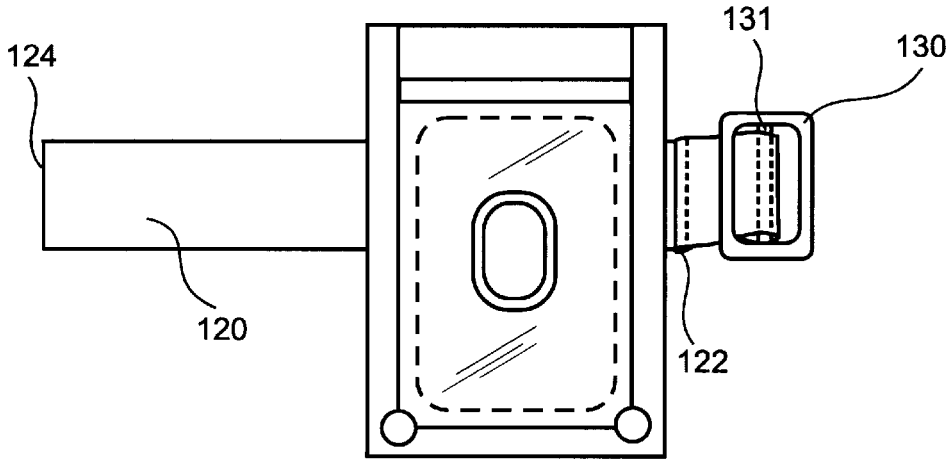
FIG. 2A illustrates another identification card holder system embodiment with a card holder permanently attached to a band. The band is shown open.
Figure 2B:
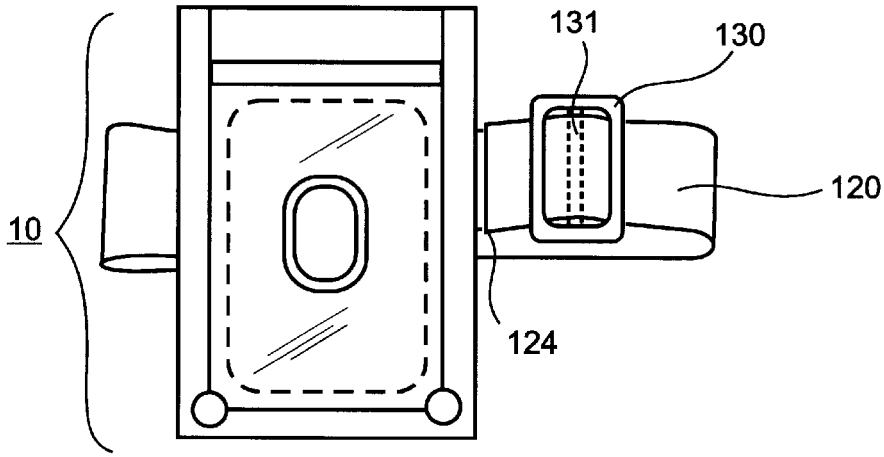
FIG. 2B illustrates the identification card holder system of FIG. 2A, with the band shown closed.

FIG. 1B shows the card holder opened to reveal its interior. The interior of the front flap (20) has an interior pocket (32). To reveal more of the pocket structure, no card is shown in interior pocket (32). Preferably, the outer face (34) of interior pocket (32) comprises a durable transparent polymeric material. The outer face (34) may also contain a reinforced hole (26). Exterior pocket (22) (FIG. 1A) and interior pocket (32) share a common inner face (35), which is visible through reinforced hole (26). Therefore, exterior pocket (22) and interior pocket (32) form back-to-back pockets which provide separated storage of identification cards. Separated storage of multiple cards allows the cards to be more easily organized. In general, separated storage of multiple cards allows proper operation of cards containing magnetic information. However, in some circumstances a smart card reader may not read the desired card correctly if smart cards are placed in both of the back-to-back pockets. The interior pocket (32) may be constructed in a similar manner to the exterior pocket (22). The interior of back flap (40) has an upper pocket (42) and a lower pocket (44). In the embodiment of FIG. 1B, the outer face of the upper pocket provides the inner face of the lower pocket. Cards stored in pockets (42) and (44) are thus separated from one another. The upper and lower pockets may be sized to accommodate smaller cards such as ATM, phone and credit cards. FIG. 1B also shows the fold line (100) which separates the two flaps.

The means for slidably attaching the identification card holder to the breakaway lanyard allows the identification holder to move along the lanyard. The identification holder not being held at a fixed point on the lanyard allows more convenient adjustment of the lanyard to fit the size of the wearer. FIG. 1A shows one embodiment of attachment means (50) for slidably attaching the identification card holder (10) to the breakaway lanyard (70). For improved durability, attachment means (50) preferably connect to a part of the card holder which is made of leather or woven material. In FIG. 1A, attachment means (50) comprises a loop of cord (52) threaded through one end (54) of a side release buckle assembly and a webbing loop (58) threaded through the other end (56) of the side release buckle assembly. The loop of cord (52) may be sewn to the identification holder (10) or may be attached by other means as known to the art. Breakaway lanyard (70) is threaded through the webbing loop (58). Preferably, the means for slidably attaching the identification holder to the breakaway lanyard incorporates a reversible fastener which allows the lanyard to be reversibly removed from the identification holder and replaced with a clip attachment, e.g. an alligator clip attachment. As shown in FIG. 1A, the reversible fastener can be a side release buckle assembly. Other types of reversible fasteners, such as clips, snaps or hook-loop material, may also be used. Attachment of the identification card holder to the reversible fastener can be achieved by cord, webbing, and/or metal or plastic rings, or by other means known to the art. Attachment of the breakaway lanyard to the reversible fastener can be also achieved by cord, webbing, and/or rings, so long as the attachment allows the sliding movement of the lanyard with respect to the identification card holder.

As illustrated in FIG. 1A, the breakaway lanyard (70) comprises a breakaway element (72) which defines a weak point at which the loop may be opened and pulled from the wearer. A variety of breakaway elements are known to the art. Preferably, the breakaway element of the invention comprises a piece of flexible piece of polymeric tubing which is sized to fit closely around the ends of the lanyard inserted therein. The ends of the lanyard may require stiffening to facilitate their insertion into the tubing. This particular form of breakaway element makes a popping noise when the loop is opened, thus alerting the wearer of possible loss or theft of the identification card holder. This form of breakaway element also provides a reattachable breakaway joint which opens at a reproducible applied force. The lanyard may be a cord, ribbon, chain, strap or other material suitable for supporting the identification card holder, so long as it can be fitted with a breakaway element. Suitable breakaway lanyards may be obtained from Westec Inc., Carriere, Miss. The breakaway lanyard (70) may also be provided with a cord slide (74) for convenient adjustment of the size of the loop formed by the lanyard.

The identification card holder may also be removed from the breakaway lanyard and connected to a clip as shown in FIG. 1C. In FIG. 1C, attachment means (80) comprises a loop of cord (52) threaded through one end (54) of a standard side release buckle assembly which is mated with the other end (57) of the buckle assembly. The other end (57) of the assembly is directly connected to alligator clip (90). As illustrated in FIGS. 1A and 1C, the means for attaching the clip to the identification holder can have elements in common (e.g. (52), (54)) with the means for attaching the attaching the lanyard to the identification holder. Preferably, the means for slidably attaching the identification holder to the breakaway lanyard incorporates a reversible fastener which allows the lanyard to be reversibly removed from the identification holder and replaced with an alligator clip attachment. As shown in FIG. 1C, the reversible fastener can be a side release buckle assembly. Other types of reversible fasteners, such as clips, snaps or hook-loop material, may also be used. Attachment of the identification card holder to the reversible fastener can be achieved by cord, webbing, and/or metal or plastic rings, or by other means known to the art. The alligator clip may be directly attached to the reversible fastener as shown in FIG. 1C or cord, webbing, and/or rings can be used.

The identification card holder may also be reversibly removed from the breakaway lanyard or clip and reversibly connected to a band. Preferably, the band may be reversibly opened and closed and can be adjusted to fit the wearer. Fasteners that permit the band to be reversibly opened and closed include slides, buckles, snaps, hooks, and hook-loop material. The band preferably comprises a stretchy material such as elastic. In a preferred embodiment, the band is sized to fit around the upper arm. The band may be reversibly attached to the identification card holder by passing it through slots made in the identification card holder, by passing it through a casing or strap attached to the identification card holder, with hook-loop material, or by other means as known in the art.

In another embodiment, shown in FIGS. 2A and 2B, the identification card holder (10) may be permanently attached to the band. By permanently attached, it is meant that the attachment of the band to the identification card holder is not easily reversible. For example, the band may be sewn directly to the back flap of the identification card holder. In this case, the identification card holder need not be provided with attachment means for either a breakaway lanyard or a clip, as shown in FIGS. 2A and 2B. FIG. 2A shows an open band (120) attached to a buckle (130) that allows the band to be reversibly opened and closed and adjusted to fit a wearer. This type of buckle is also called a three bar slide. As shown in FIG. 2A, the band can be attached to the buckle by looping a first end (122) of the band around the center bar (131) of the buckle and sewing the loop closed. As shown in FIG. 2B, the band can be closed by passing the second end (124) of the band under the outer bars and over the center bar (131) of the buckle. Other fasteners that permit the band to be reversibly opened and closed and adjusted in size include slides, buckles, snaps, hooks, and hook look material. The fasteners may be attached to the band by any means known to the art. In this embodiment, the band preferably comprises a stretchy material such as elastic.

The disclosure is provided for illustrative purposes and is not intended to limit the scope of the invention as claimed herein. Any variations in the exemplified articles which occur to the skilled artisan are intended to fall within the scope of the present invention.

I claim:

1. A system for holding at least one identification card comprising:

an identification card holder comprising a front flap and a back flap, the front flap comprising an exterior and an interior pocket each sized to hold at least one identification card, the exterior and the interior pockets being back-to-back and having a common inner face, wherein the exterior pocket opens to the interior side of the front flap, the outer face of the exterior pocket and interior pockets comprises transparent polymeric material and the outer face of the exterior pocket comprises a reinforced hole through which a finger may be inserted to aid in removing an identification card from the pocket;

a breakaway lanyard comprising a breakaway element; and means for slidably attaching the identification holder to the breakaway lanyard.

2. The system of claim 1 wherein the outer face of the interior pocket comprises a reinforced hole through which a finger may be inserted to aid in removing the identification cards from the pocket.

3. The system of claim 1 wherein the back flap of the identification card holder comprises additional pockets.

4. The system of claim 1 wherein the breakaway element comprises a piece of flexible piece of polymeric tubing which is sized to fit closely around the ends of the lanyard inserted therein.

5. The system of claim 1 additionally comprising a slide to adjust lanyard length.

6. The system of claim 1 additionally comprising a clip and means for attaching the identification card holder to the clip including a reversible fastener wherein the breakaway lanyard is reversibly interchangeable with the clip.

7. An identification card holder system comprising an identification card holder comprising a front flap and a back flap, the front flap comprising an exterior and an interior pocket each sized to hold at least one identification card, the exterior and the interior pockets being back-to-back and having a common inner face and comprising a first material which is a transparent polymer sheet and a second material which is a woven material or leather;

a breakaway lanyard; and means for slidably attaching the identification holder to the breakaway lanyard, wherein the means for slidably attaching the identification holder to the lanyard comprises a loop of cord or webbing attached to the identification holder and a reversible fastener attached to both the breakaway lanyard and the cord or webbing.

8. The system of claim 7 wherein one face of at least one of the pockets additionally comprises a reinforced hole through which a finger may be inserted to aid in removing the identification card from the pocket.

9. The identification card holder system of claim 7, wherein the outward face of each of the back-to-back pockets comprises the first transparent material, whereby the identification card can be viewed or through the transparent material.

10. The system of claim 7 wherein the breakaway element comprises a piece of flexible piece of polymeric tubing which is sized to fit closely around the ends of the lanyard inserted therein.

11. The system of claim 7 additionally comprising a clip and means for attaching the identification card holder to the clip including a reversible fastener wherein the breakaway lanyard is reversibly interchangeable with the clip.

12. An identification card holder system comprising a front flap and a back flap, the front flap comprising an exterior and an interior pocket each sized to hold at least one identification card, the exterior and the interior pockets being back-to-back and having a common inner face, wherein the exterior pocket opens to the interior side of the front flap, the pockets comprising a first material which is a transparent polymer sheet and a second material which is a woven material or leather, the outer face of the exterior pocket and interior pockets comprising transparent polymeric material and the outer face of the exterior pocket comprises a reinforced hole through which a finger may be inserted to aid in removing an identification card from the pocket; and a band permanently attached to the identification card holder.

* * * * *